United States Patent [19]

Russel et al.

[11] Patent Number: 4,903,952

[45] Date of Patent: Feb. 27, 1990

[54] FINISHER APPARATUS

[75] Inventors: Steven M. Russel, Pittsford; John T. Bricklemyer, Honeoye Falls; Robert H. Shea, Victor, all of N.Y.

[73] Assignee: Eastman Kodak Company, Rochester, N.Y.

[21] Appl. No.: 237,352

[22] Filed: Aug. 29, 1988

[51] Int. Cl.[4] ..... B42B 1/02

[52] U.S. Cl. ..... 270/53; 227/111

[58] Field of Search ..... 270/37, 53, 58; 227/81, 227/110, 111

[56] References Cited

U.S. PATENT DOCUMENTS 4,196,835 4/1980 Schlough ..... 227/81

4,552,497 11/1985 Kockler ..... 270/53

*Primary Examiner*—Randall L. Green

*Assistant Examiner*—Therese M. Newholm

*Attorney, Agent, or Firm*—Lawrence P. Kessler

[57] ABSTRACT

A finishing apparatus capable of binding a plurality of stacked sheets together at any of a plurality of selected location along an edge of the sheet stack. This apparatus comprises a mechanism for moving sheets seriatem along a path, and compiling such sheets in a stack. A binding unit is mounted for movement relative to such sheet path in juxtaposition to an edge of a compiled stack of sheets. The drive for moving the binding unit is controlled so that the binding unit can effect binding of a compiled stack of sheets at any of a plurality of locations along the edge. In a preferred embodiment of this invention, the drive for the binding unit is a stepper motor coupled to the binding unit. A microprocessor based logic and control unit activates the stepper motor through a predetermined number of steps to position the binding unit at a particular desired location relative to the edge of a compiled sheet stack. One important aspect of this invention is that the geometry of the binding unit is such that the binding unit does not have to return to its home position to be out of the travel path of the sheet stack from its compiled location toward a downstream location.

21 Claims, 5 Drawing Sheets

FINISHER APPARATUS

BACKGROUND OF THE INVENTION

This invention relates in general to apparatus for finishing a plurality of receiver sheets from a reproduction machine into a completed booklet, and more particularly to a finishing apparatus capable of binding a plurality of stacked receiver sheets together at any selected location along an edge of the receiver sheet stack.

In an effort to increase the overall throughput rate of reproduction machines to reproduce finished complete sets, certain such machines have been provided with finisher apparatus which can assemble individual receiver sheets into completed booklets. One type of finisher apparatus employs a stapler device for automatically binding a plurality of receiver sheets into a desired completed booklet. The stapler device may be of the type utilizing preformed staples of a particular size, such as shown in U.S. Pat. No. 4,313,670, issued Feb. 2, 1982, in the name of Caldwell for example. Alternatively, to increase the capability of a stapler device to bind a wide range of different numbers of sheets without producing poorly fastened booklets or undesirable overlapped staples, stapler devices have been proposed which produce staples of different lengths. Such devices utilize either preformed staples of different lengths or a continuous length of staple material from which desired length staples are cut. When preformed staples are used, the entire stapling mechanism has to be changed to accommodate the different length staples. A device using continuous staple material is shown in U.S. Pat. No. 4,318,555, issued March 9, 1982, in the name of Adamski et al. Devices utilizing continuous staple material are more efficient than devices utilizing preformed staples in that different length staples can be selected depending upon the number of sheets to be bound together into a booklet.

In general, staplers of either of the above-described types place staples at a preselected location relative to a sheet stack edge. In order to accommodate a variety of staple locations relative to the sheet stack edge, it has been proposed to provide a multiplicity of adjustably located stapler heads (see for example U.S. Pat. No. 4,516,714, issued May 14, 1985, in the name of Braun et al.). The inclusion of multiple stapler heads results in a significantly complicated and expensive finisher apparatus structure. Moreover, even with adjustable multiple head staplers, the number of staple locations which can be provided along a sheet stack edge is limited by the location of the heads relative to the sheet stack edge.

SUMMARY OF THE INVENTION

This invention is directed to a finishing apparatus utilizing a single stapler capable of binding a plurality of stacked sheets together at any of a plurality of selected locations along an edge of the sheet stack. This apparatus comprises a mechanism for moving sheets seriatem along a path, and compiling such sheets in a stack. A binding unit is mounted for movement relative to such sheet path in juxtaposition to an edge of a compiled stack of sheets. The drive for moving the binding unit is controlled so that the binding unit can effect binding of a compiled stack of sheets at any of a plurality of locations along the edge. In a preferred embodiment of this invention, the drive for the binding unit is a stepper motor coupled to the binding unit. A microprocessor based logic and control unit activates the stepper motor through a predetermined number of steps to position the binding unit at a particular desired location relative to the edge of a compiled sheet stack. One important aspect of this invention is that the geometry of the binding unit is such that the binding unit does not have to return to its home position to be out of the travel path of the sheet stack from its compiled location toward a downstream location.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
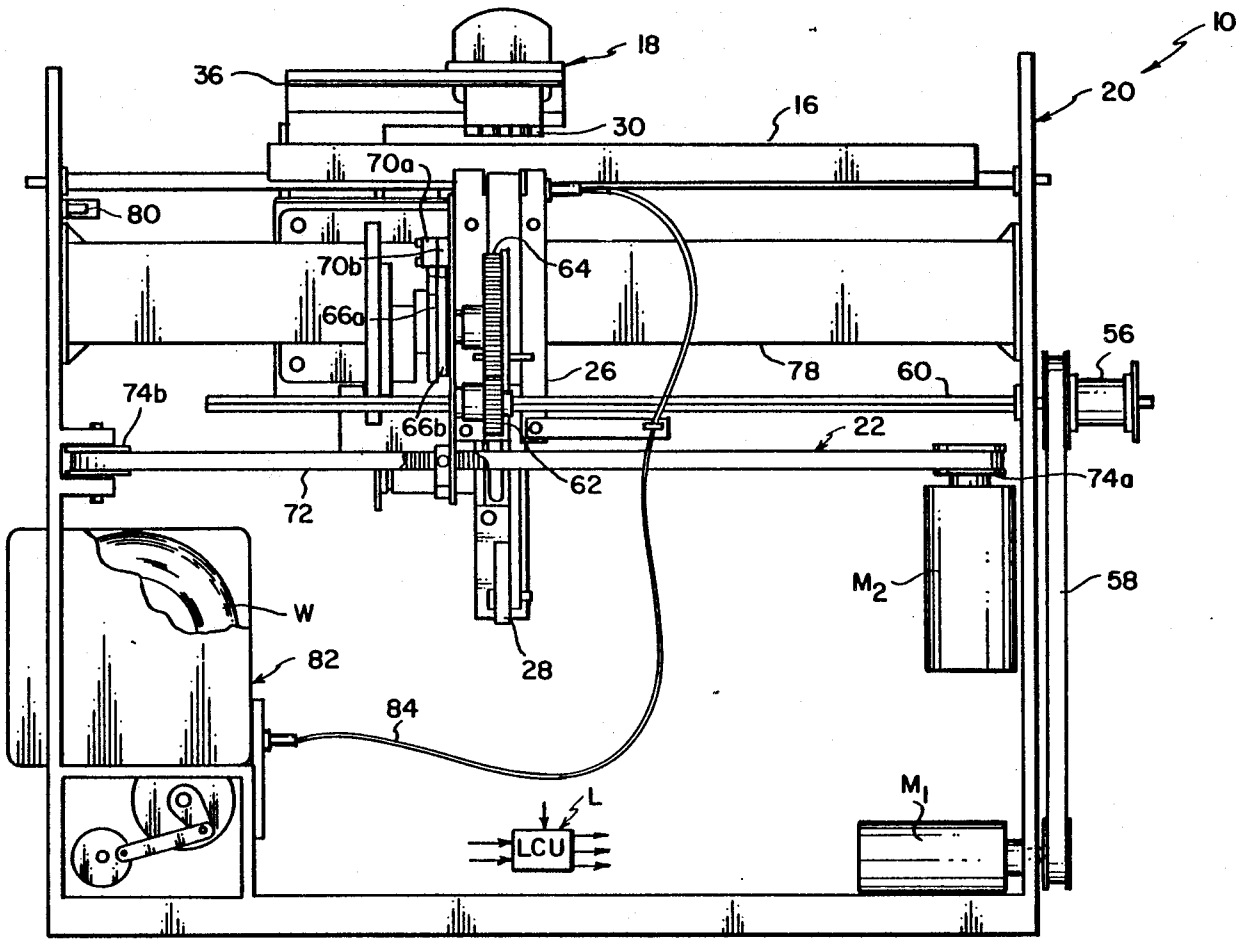
FIG. 1 is an end elevational view of the finisher apparatus according to this invention.

Referring now to the accompanying drawings, a finishing apparatus, according to this invention, is designated generally by the numeral 10. The apparatus 10 is located relative to a receiving tray 12 positioned to accumulate receiver sheets from a reproduction machine, for example, traveling in the direction of arrow A along a sheet travel path P (see FIG. 2). A transport mechanism 14, such as driven nip rollers for example, delivers sheets seriatem to the tray 12. The sheets are registered in the tray along one edge against a pivotable gate 16 and compiled into a stack S. The apparatus 10, positioned transverse to the travel path P, includes a binder assembly such as a single head stapler 18 which is operatively associated with the registered edge of the sheet stack S so as to be capable of binding such sheets together along such edge.

The stapler 18 is controlled by a logic and control unit L. The logic and control unit L includes, for example, a microprocessor receiving input and timing signals, such as from the transport mechanism 14 and/or the apparatus 10. Based on such signals and a program from the microprocessor, the unit L produces signals to control the operation of the apparatus 10 for carrying out the stapling operation. The production of the program for a number of commercially available microprocessors suitable for use with this invention is a conventional skill well understood in the art. The particular details of any such program would, of course, depend on the architecture of the designated microprocessor.

The apparatus 10 comprises a frame 20 supporting the stapler 18 and a stapler positioner mechanism 22 (see FIG. 1). The stapler 18 has a main body portion 26 supporting a stapler driver bar 28 and a clincher assembly 30. The specific details of the stapler drive bar 28 and clincher assembly 30 for a stapler utilizing continuous staple wire may be of any particular construction well known in the art, suitable for use with this invention as long as the stapler is movable, in the manner according to the invention as hereinafter described, relative to the sheet stack edge to be bound.

The clincher assembly 30 of the stapler 18 incorporates a clincher head 32 actuatable by a solenoid 34 to complete staple formation. The clincher head 32 and solenoid 34 are mounted on an offset arm 36 which is, in turn, pivotably mounted on a shaft 38 carried by the body portion 26 (see FIG. 2). The offset geometry of the clincher assembly 30, along with the overall positioning of the stapler 18 as described hereinbelow, maintains the stapler out of the travel path of a bound stack of sheets from the tray 12 toward a downstream location.

Figure 4:
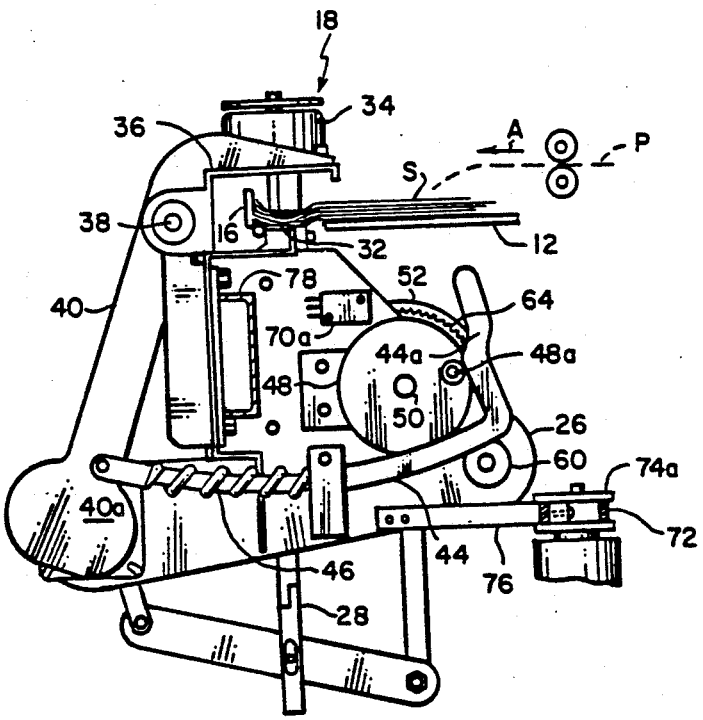
FIG. 4 is a front elevational view, similar to FIG. 2, showing the stapler in its stapling position.

A clincher brake arm 40 is integrally connected to the offset arm 36. The brake arm 40 is selectively movable to move the arm 36, and thus the clincher head 32, about the shaft 38 to its non-stapling position of FIG. 2 or its stapling position of FIG. 4. In order to provide for movement of the brake arm 40, the brake arm is coupled to a lift link 44. A portion **44*a* of the lift link is urged by a spring 46 into engagement with a pin 48*a* extending from a clincher control crank 48. The crank 48 is mounted for rotation with a crank shaft 50 which is supported by the stapler body portion 26. As the crank shaft 50 is rotated through one-half revolution from the position in FIG. 2 to the position in FIG. 4, the pin 48*a* disengages the portion 44*a* and the spring 46 is free to urge the link 44 to move to the left (in such FIGS.). Such movement causes the arm 40 to pivot about the shaft 38 bringing the clincher head 32 into clamping engagement with the top of a sheet stack S compiled on the tray 12. On the one-half revolution from the position of FIG. 4 to the position of FIG. 2, the crank 48 is returned so that the pin 48*a* reengages portion 44*a* of the lift link 44 to move the brake arm 40, against the urging of the spring 46, thereby moving the clincher head 32** to its non-clamping position.

By this spring-aided arrangement, it can readily be appreciated that the clincher head 32 is always urged into proper engagement with the top of the sheet stack. With the clincher head 32 of the clincher assembly 30 engaged with the top of the sheet stack, a magnetic brake 42 is energized to hold the clincher head 32 in its particularly assumed position. The magnetic brake 42 acts on a paddle-like portion **44*a* of the brake arm 40. The enlargement of the paddle-like portion 44*a* is such that the magnetic brake 42 is effective to lock the arm 40 in position over a substantial angle assumed by the arm dependent upon the height of the sheet stack and the engagement of the clincher head 32 with the top of the stack. Accordingly, the use of a magnetic brake 42 enables the clincher head 32** to be held in its particular assumed position relative to the top of the sheet stack S, determined by the stack height, irrespective of such position.

Figure 5:
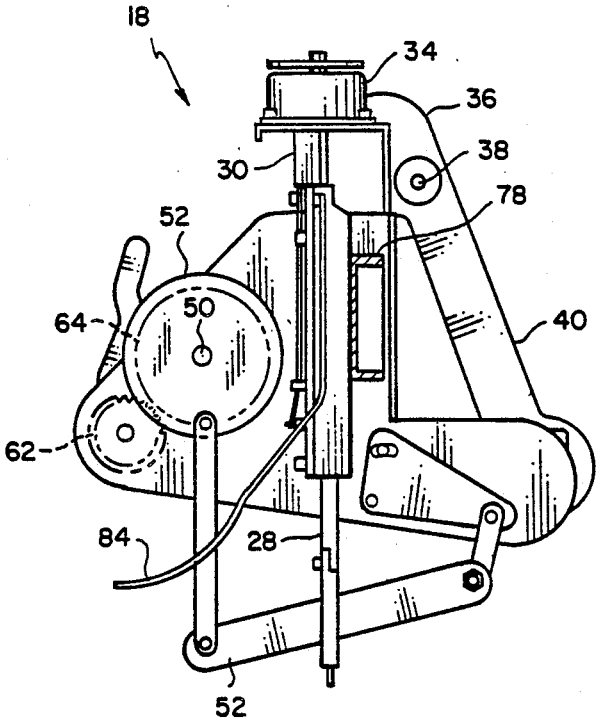
FIG. 5 is a rear elevational view, similar to FIG. 4, showing the stapler in its stapling position.

Rotation of the crank shaft 50 is also utilized to actuate the stapler drive bar 28. A stapler drive bar control crank 52 is mounted for rotation with the shaft 50. The crank 52 is coupled through a linkage arrangement 54 (see FIG. 3) to the drive bar 28. As the shaft 50 rotates through one-half revolution from the position of FIG. 3 to the position of FIG. 5, the crank 52 actuates the drive bar 28 to move the drive bar up to effect stapling of the stack of sheets in cooperation with the clincher assembly 30 from a continuous roll of staple wire. As best seen in FIG. 1, the roll of staple wire W is appropriately fed under control of the logic and control unit L from a supply 82 through a flexible conduit 84 fixed at its ends respectively to the supply 82 and the stapler body 26. On the one-half revolution of the shaft 50 and crank 52 from the position of FIG. 5 to the position of FIG. 3, the drive bar 28 is returned to its position ready to repeat the stapling operation on the next subsequent one-half revolution.

Rotation of the crank shaft 50 is effected by a main drive motor $M_1$. The motor $M_1$ is coupled to the input of a one revolution clutch 56 through a drive belt 58. The output of the one revolution clutch 56 is attached to a hex shaft 60. An input gear 62, supported by the body portion 26 of the stapler 18, has a complimentary hex-shaped bore for receiving the shaft 60. The gear 62 is thus mounted for rotation with the shaft 60, while being capable of longitudinal movement relative thereto. Such longitudinal movement enables the stapler 18 to assume any number of various positions along the shaft 60 while maintaining the drive relationship of the gear 62 by the shaft 60. An output gear 64, mounted on the crank shaft 50 for rotation therewith, is in mesh with the input gear 62. Accordingly, as the shaft 60 rotates, the gear 62 causes the crank shaft 50 to be rotated. The gear 64 has a two to one tooth ratio with respect to the gear 62 so that when the clutch 56 is activated by the unit L to enable the motor $M_1$ to rotate the shaft 60 through one revolution, the crank shaft 50 is rotated through one-half revolution.

A pair of timing cams **66*a*, 66*b* are mounted on the crank shaft 50 for rotation therewith. As the cams rotate with the crank shaft, they respectively open and close switches 70*a*, 70*b* supported by the body portion 26 of the stapler 18. The switches produce signals for the logic and control unit L to enable the unit to control activation of the magnetic brake 42 and the clincher solenoid 34 based on the degree of rotation of the crank shaft 50**.

According to this invention, the stapler 18 is movable transverse to the edge of a compiled sheet stack S to place staples at any of a plurality of desired locations along such edge. The positioner 22 for moving the stapler 18 includes a stepper motor $M_2$ for driving a closed-loop belt 72 entrained about a pulley **74*a*, coupled to the output shaft of the motor, and a pulley 74*b* supported by the frame 20. The belt 72 is coupled to an arm 76 extending from the body 26 of the stapler. A channel member 78, carried by the frame 20, supports the stapler body 26 for slidable movement therealong as the belt 72 is moved by the motor $M_2$. The precise location of the stapler 18 for particular placement of staples along the sheet stack edge is determined by actuation of the motor $M_2$ so as to move the stapler a given distance from a home position on the channel 78 where the stapler is in engagement with a home position sensor 80. The stepping of the motor $M_2$ is controlled by the unit L and is dependent upon the desired location (locations) for a staple along the sheet stack edge. The unit causes the motor $M_2$ to rotate through a predetermined number of steps to move the belt 72, and thus the stapler 18 through its interconnection with the belt through the arm 76, a distance which will assure proper location of the staple when the stapler 18** is actuated.

In operation of the binder apparatus 10, once a desired number of sheets are compiled on the tray 12 in a stack S, the stapler 18 is moved along the channel 78 and hex shaft 60, to a desired location relative to the edge of the sheet stack measured from the home position of the stapler in engagement with the sensor 80.

The logic and control unit L converts an operator initiated input signal indicative of desired staple location to an output signal to the stepper motor $M_2$ corresponding to the number of steps required for the stapler to assume the desired relative location. Of course, if multiple staples are to be placed in the stack, the stapler 18 is moved to the first staple location and the signals of the remaining staple locations are stored for subsequent activation of the motor $M_2$ until stapling at the first location is accomplished. Once the stapler 18 is located at the desired location, the unit L sends a signal to the one revolution clutch 56. Activation of such clutch enables the motor $M_1$ to rotate the shaft 60 to rotate through 360°.

As the shaft 60 rotates, the gear 62 will rotate the gear 64, and thus the crank 48. Since the gear 64 has a two to one tooth ratio with gear 62, the crank 48 rotates through 180°. During this degree of rotation, the linkage mechanism 54 is moved from the position shown in FIG. 3 to the position shown in FIG. 5 to effect movement of the stapler drive bar 28 for production of a staple. Simultaneously, the pin 48*a* is moved from the position shown in FIG. 3 to the position shown in FIG. 5 to effect movement of the clincher 32 to its operative position relative to the sheet stack S. At appropriate times during this rotation of the crank 48, the switches 70*a* and 70*b* are actuated to activate the magnetic brake 42 to hold the clincher head 32 in clamping relation with the sheet stack S, and thereafter activate the clincher solenoid 34 to complete the clinching operation. The clincher solenoid 34 operates while the stapler drive bar 28 is at rest. The use of the magnetic brake 42 for holding the clincher head 32 in clamping relation with the sheet stack S, reduces the size of the spring 46 since such spring is not required to maintain the clamping relation as practiced in the prior art.

After the stapling operation is completed, the clutch 56 is again activated by the logic and control unit L. The shaft 60 is thus again rotated through 360°. Such rotation returns the crank 48 to the position of FIGS. 2 and 3 where the linkage 54 resets the stapler drive bar 28 and the lift link 44 moves the clincher head 32 to its non-clamping position. If a subsequent staple is to be placed in the stack S, the stapler is advanced by the stepper motor $M_2$ to the new location, and the operation is repeated until all desired staples are formed to bind the stack edge. When a plurality of staples are desired to bind the edge of the sheet stack, the first formed staple is the staple farthest from the the home position of the stapler 18. Subsequent desired staples are formed in order progressing toward the home position.

Figure 2:
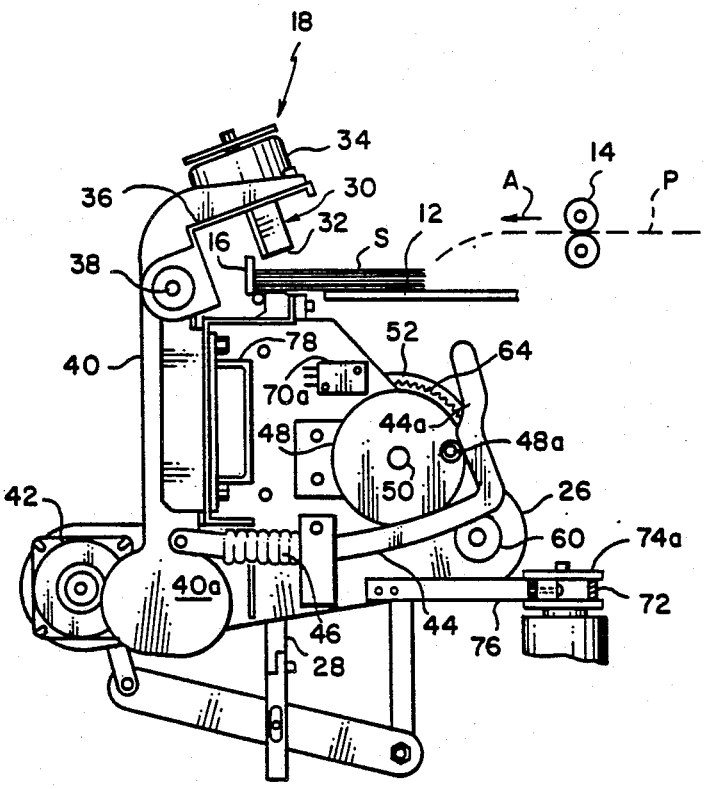
FIG. 2 is a front elevational view of a portion of the finisher apparatus of FIG. 1 including the movable stapler, in its non-stapling position.
Figure 3:
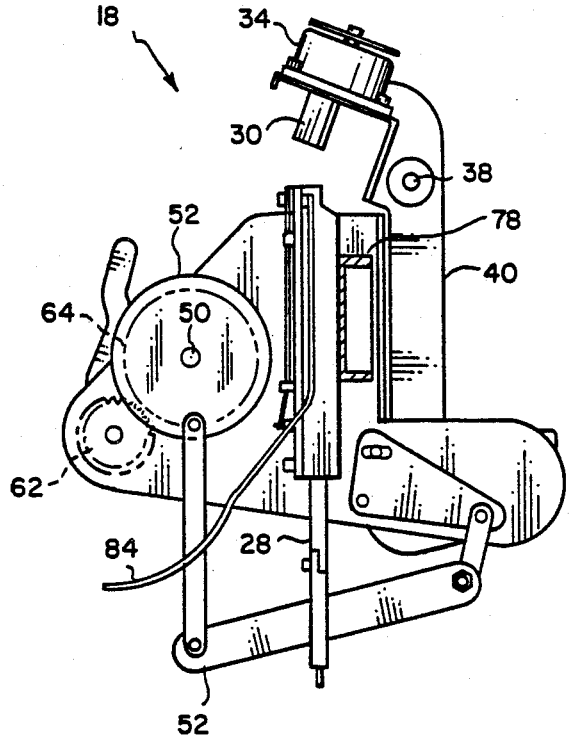
FIG. 3 is a rear elevational view of the stapler of FIG. 2 in its non-stapling position.

Once the last staple is binding the stack edge is completed (with the clincher assembly 30 being returned to its position of FIGS. 2 and 3), the bound stack is ready to be fed from the tray 12 toward a downstream location. The offset geometry of the arm 36 of the clincher assembly results in the stapler 18 being out of the exit path of the bound stack, or requiring only minimal movement toward the home position to be out of the stack exit path. Accordingly, the gate 16 can be lowered and the bound stack fed from the tray to a downstream location. Thereafter, the gate is raised and the binder apparatus 10 is ready to accept the next sheets for accumulation and binding. Because the position of the stapler 18 along the channel 78, relative to the edge of the stack to be bound, is under the control of the logic and control unit L, such position may be stored in the memory of the unit whereby operation of the stepper motor $M_2$ can be controlled to move the stapler directly to a new position without having to return to its home position in engagement with the sensor 80. Accordingly, the positioning of the stapler 18 at its home position need only be effected at initial power up of the binder apparatus 10.

The invention has been described in detail with particular reference to a preferred embodiment thereof, but it will be understood that variations and modifications can be effected within the spirit and scope of the invention.

We claim:

1. A finishing apparatus adapted to receive a plurality of sheets, and bind such sheets into a completed set, said apparatus comprising:

means for moving sheets seriatem along a path, and compiling such sheets in a stack;

a frame including a channel member located substantially parallel to an edge of a compiled stack of sheets;

a binding unit including a stapler having a body member slidably mounted on said channel for movement relative to such sheet path in juxtaposition to the edge of such compiled stack of sheets, a selectively actuated stapler drive head supported by said stapler body member, a selectively actuated clincher assembly supported by said stapler body member, and means for actuating said drive head to initiate formation of a staple and for actuating said clincher assembly to locate said clincher assembly in engagement with a compiled stack of sheets opposite said drive head and complete staple formation initiated by said drive head; and drive means for controlling movement of said binding unit whereby said binding unit can effect binding of a compiled stack of sheets at any of a plurality of locations along said edge.

2. The invention of claim 1 wherein said drive means includes a motor having an output shaft, means for coupling said output shaft to said stapler body member, and control means for activating said motor to move said stapler body member along said channel to a desired location relative to said edge of a compiled stack of sheets.

3. The invention of claim 2 wherein said motor is a stepper motor, and said control means causes said stepper motor to operate through a predetermined number of steps to move said stapler body member a corresponding distance from a home position of said stapler body member on said channel.

4. The invention of claim 3 wherein said control means includes means for remembering the relative position of said stapler body member on said channel, and activating said stepper motor to operate through a number of steps which will move said stapler body member to a subsequent position without returning first to said home position.

5. The invention of claim 1 wherein said body member includes a pivot shaft, and said clincher assembly includes an arm mounted on said pivot shaft for rotation thereabout and a clincher head attached to said arm whereby when said arm rotates about said pivot shaft said clincher head is located in a first position in engagement with a compiled stack of sheets and a second position where said clincher head is remote from said compiled stack of sheets.

6. The invention of claim 5 wherein one portion of said arm extends from said pivot shaft above said stapler body member so as to locate said clincher head above said drive head.

7. The invention of claim 6 wherein said arm is offset, whereby said stapler body member may be located to position said drive head and clincher head in position to staple said edge of a compiled stack of sheets while said body member lies out of an exit travel path for said sheet stack toward a downstream location.

8. The invention of claim 5 wherein said actuating means includes a rotatable shaft, a crank rotatably supported by said stapler body member, means for coupling said crank to said rotatable shaft for rotation of said crank by said rotatable shaft, a linkage coupling a portion of said crank to said drive head to actuate said drive head on rotation of said crank, a lift link coupling another portion of said crank to said clincher assembly to locate said clincher head in said first position or said second position on rotation of said crank, and means for selectively rotating said rotatable shaft to effect rotation of said crank.

9. The invention of claim 8 wherein said means for coupling said crank to said rotatable shaft includes a first gear rotatably supported by said stapler body member fixed to and coaxial with said crank, and a second gear supported for rotation with said rotatable shaft, said second gear being in mesh with said first gear and the tooth ratio of said first gear to said second gear being two to one, whereby one revolution of said rotatable shaft results in one-half revolution of said crank.

10. The invention of claim 9 wherein said rotatable shaft is of hexagonal cross-section and is supported in said frame, and said second gear includes a complimentary shaped hexagonal bore adapted to receive said rotatable shaft, whereby said second gear rotates with the rotatable shaft when said shaft is rotated and is capable of longitudinal movement, with said stapler body member, relative to said shaft.

11. The invention of claim 10 wherein said means for selectively rotating said rotatable shaft includes a motor and a one revolution clutch, said motor being coupled to the input of said one revolution clutch and said rotatable shaft being coupled to the output of said one revolution clutch, whereby when said clutch is engaged said motor will effect rotation of said rotatable shaft through one revolution.

12. The invention of claim 8 wherein a second portion of said arm extends from said pivot shaft in a direction substantially opposed to said one portion of said arm, and wherein said stapler body member further includes means for selectively interacting with said second portion of said arm to maintain said arm in its position where said clincher head is in its first position during staple formation.

13. The invention of claim 12 wherein said interacting means includes a magnetic brake and means for activating said magnetic brake to hold said second portion of said arm in said position where said clincher head is in its first position.

14. The invention of claim 13 wherein said activating means includes means responsive to rotation of said crank to a predetermined angular position for producing a signal which activates said magnetic brake.

15. For use with a reproduction device electrostatographically reproducing information on a plurality of sheets respectively, an apparatus for binding such sheets into a completed set, said apparatus comprising:

means for moving sheets seriatem along a path, and compiling such sheets in a stack;

a frame including a channel member located substantially parallel to said edge of a compiled stack of sheets;

a stapler unit including a body member slidably mounted for movement on said channel member relative to an edge of a compiled stack of sheets, said body member supporting a selectively actuated stapler drive head, means for feeding continuous stapler wire to said drive head, and a selectively actuated clincher assembly; and means for actuating said drive head to initiate formation of a staple from said continuous staple wire and for actuating said clincher assembly to locate said clincher assembly in engagement with a compiled stack of sheets and complete staple formation initiated by said drive head; and drive means for controlling movement of said stapler unit along said channel member, said drive means including a first motor having an output shaft, means for coupling said output shaft to said stapler body member, and control means for activating said motor to move said stapler body member along said channel to any desired location relative to said edge of a compiled stack of sheets, whereby said stapler unit can effect stapling of a compiled stack of sheets at any of a plurality of locations along said edge.

16. The invention of claim 15 wherein said first motor is a stepper motor, and said control means causes said stepper motor to operate through a predetermined number of steps to move said stapler body member a corresponding distance from a home position of said stapler body member on said channel; and wherein said control means includes means for remembering the relative position of said stapler body member on said channel, and activating said stepper motor to operate through a number of steps which will move said stapler body member to a subsequent position without returning first to said home position.

17. The invention of claim 16 wherein said body member includes a pivot shaft, and said clincher assembly includes a clincher head and an arm, one portion of said arm extending from said pivot shaft above said stapler body member, said clincher head being attached to the extended end of said arm so as to locate said clincher head above said drive head, said arm being mounted on said pivot shaft for rotation thereabout for locating said clincher head in a first position in engagement with a compiled stack of sheets, and a second position where said clincher head is remote from said compiled stack of sheets.

18. The invention of claim 17 wherein said arm is offset, whereby said stapler body member may be located to position said drive head and clincher head in position to staple said edge of a compiled stack of sheets while said body member lies out of an exit travel path for said sheet stack toward a downstream location.

19. The invention of claim 17 wherein said actuating means includes a rotatable shaft, a crank rotatably supported by said stapler body member, means for coupling said crank to said rotatable shaft for rotation of said crank by said rotatable shaft, a linkage coupling a portion of said crank to said drive head to actuate said drive head on rotation of said crank, a lift link coupling another portion of said crank to said clincher assembly to locate said clincher head in said first position or said second position on rotation of said crank, and means for selectively rotating said rotatable shaft to effect rotation of said crank.

20. The invention of claim 19 wherein said rotatable shaft is of hexagonal cross-section and is supported in said frame; and said means for coupling said crank to said rotatable shaft includes a first gear rotatably supported by said stapler body member fixed to and coaxial with said crank, and a second gear including a complimentary shaped hexagonal bore adapted to receive said rotatable shaft so that said gear is rotatable with said rotatable shaft and is capable of longitudinal movement, with said stapler body member, relative to said shaft, said second gear being in mesh with said first gear and the tooth ratio of said first gear to said second gear being two to one; and wherein said means for selectively rotating said rotatable shaft includes a second motor and a one revolution clutch, said second motor being coupled to the input of said one revolution clutch and said rotatable shaft being coupled to the output of said one revolution clutch, whereby when said clutch is engaged said second motor will effect rotation of said rotatable shaft through one revolution and, due to the tooth ratio of said first and second gears, one-half revolution of said crank.

21. The invention of claim 20 wherein a second portion of said arm extends from said shaft in a direction substantially opposed to said one portion of said arm, and wherein said stapler body member further includes a magnetic brake and means responsive to rotation of said crank to a predetermined angular position for producing a signal which activates said magnetic brake to hold said second portion of said arm in said position where said clincher head is in its first position during staple formation.

* * * * *